US005388924A

United States Patent [19]

Chao

[11] Patent Number: 5,388,924

[45] Date of Patent: Feb. 14, 1995

[54] DRAWING PEN HAVING MULTIPLE SIDE-MATCHED ABSORPTIVE DRAWING TIPS

[76] Inventor: Chung L. Chao, No.7-5, Lane 339, Wu Chuan Rd., Taichung, Taiwan, Prov. of China

[21] Appl. No.: 192,575

[22] Filed: Feb. 7, 1994

[51] Int. Cl.[6] ..... B43K 8/02; B43K 27/00

[52] U.S. Cl. ..... 401/35; 401/198; 401/199

[58] Field of Search ..... 401/34, 35, 198, 199, 401/17

[56] References Cited

U.S. PATENT DOCUMENTS

| | | | |
|---|---|---|---|
| 3,887,287 | 6/1975 | Rosh, Jr. | 401/35 |
| 4,795,156 | 1/1989 | Paulish | 401/35 X |

FOREIGN PATENT DOCUMENTS

| | | | |
|---|---|---|---|
| 3342648 | 6/1985 | Germany | 401/35 |
| 3918373 | 12/1990 | Germany | 401/35 |
| 521507 | 3/1955 | Italy | 401/35 |
| 258999 | 10/1989 | Japan | 401/35 |
| 2243995 | 11/1991 | United Kingdom | 401/35 |

*Primary Examiner*—Steven A. Bratlie

[57] ABSTRACT

A drawing pen for drawing lines having different shades, including a plurality of ink reservoirs received within a barrel thereof, and a plurality of absorptive drawing tips respectively connected to the ink reservoirs at the bottom and disposed outside the barrel for drawing, wherein the absorptive drawing tips having adjacent surfaces are complementary and engaged to one another by a watertight bonding agent.

6 Claims, 7 Drawing Sheets

DRAWING PEN HAVING MULTIPLE SIDE-MATCHED ABSORPTIVE DRAWING TIPS

BACKGROUND OF THE INVENTION

The present invention relates to a drawing pen having multiple side-matched absorptive drawing tips each engaged to one or more adjacent absorptive drawing tips for drawing lines having different shades.

In drawing a post, drawing, artwork, etc., multiple-tip markers may be used to draw lines having different shades to show the contrast between distances. FIG. 11 shows an absorptive drawing tip connected to two different ink reservoirs at the bottom for drawing lines of two different shades. Because the absorptive drawing tip is integrally made, the inks may merge into each other causing a color change. Therefore, this integral structure of absorptive drawing tip is not practical for drawing lines having different shades.

There is another structure of marker having two absorptive drawing tips for drawing lines of different shades. The two absorptive drawing tips, as shown in FIG. 12, are side-matched and separated by a plastic film. Because the two absorptive drawing tips are separated by the plastic film, they cannot draw lines having different shades. When the absorptive drawing tips are simultaneously and perpendicularly moved on the paper, two lines of different shades are applied with a blank space or line maintained in between. Another drawback of this drawing pen structure is that the absorptive drawing tips can wear off after prolonged use and cause the plastic film to project or extend out over the absorptive drawing tips. When the plastic film projects or extends out over the absorptive drawing tips, it may damage the paper easily.

SUMMARY OF THE INVENTION

The present invention has been accomplished under the aforesaid circumstances. It is therefore the principal object of the present invention to provide a drawing pen which is practical for drawing lines having different shades. According to the present invention, the drawing pen has multiple absorptive drawing tips side-matched and fastened with one another by a watertight bonding agent.

DETAILED DESCRIPTION OF THE PREFERRED EMBODIMENTS

Figure 1:
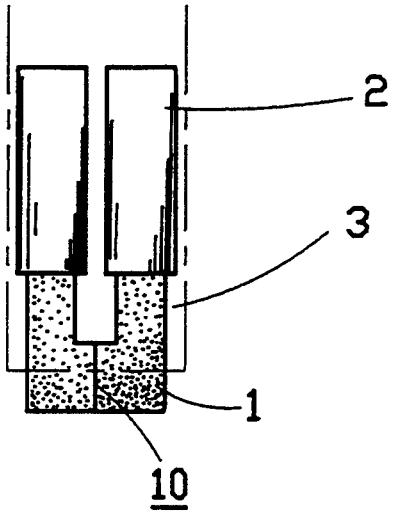
FIG. 1 is an elevated view of the lower part of a drawing pen according to one embodiment of the present invention, showing two absorptive drawing tips side-matched.
Figure 2:
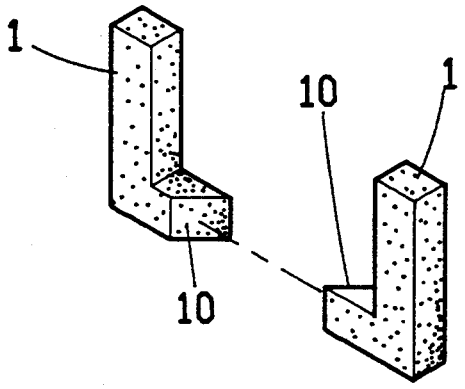
FIG. 2 is an exploded view of the two absorptive drawing tips shown in FIG. 1.
Figure 3:
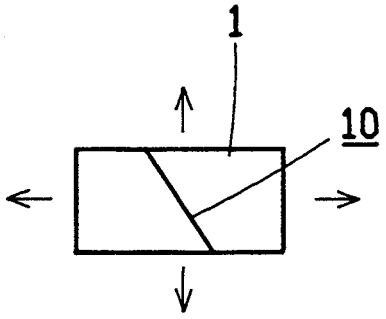
FIG. 3 is a bottom view of the side-matched absorptive drawing tips shown in FIG. 1.

The drawing pen of the invention is comprised of a plurality of ink reservoirs located in the barrel of the pen and connected to the top end of a plurality of absorptive drawing tips. The tip end of absorptive drawing tips extend outside the barrel of the pen for drawing and are side-matched and fastened to one another by a watertight bonding agent. The term "side-matched" is intended to mean that two adjacent surfaces of absorptive drawing tips are complimentarily engaged to each other at the tip end and adhered together with a watertight bonding agent.

Figure 9:
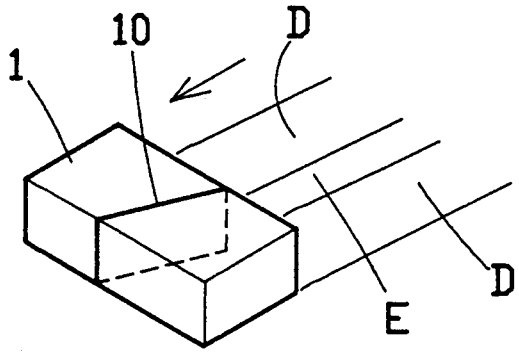
FIG. 9 shows a line of different shades drawn by two side-matched absorptive drawing tips according to the present invention.
Figure 12:
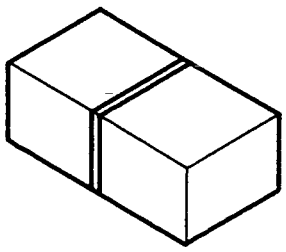
FIG.12 PRIOR ART
FIG. 12 shows two absorptive drawing tips side-matched and separated by a plastic film according to the prior art.

Referring to FIGS. 1, 2, 3, and 9, two side-matched drawing tips 1 are connected to a respective ink reservoir 2. The drawing tips I are respectively made of an absorptive fiber, and side-matched through a plane miter joint 10. The connecting area between the two drawing tips 1 is sealed with a watertight bonding agent. The two ink reservoirs 2 of the two drawing tips 1 are filled with a respective ink of the same color but in a different shade. When the side-matched drawing tips 1 are moved in contact with a paper substrate, a line having different shades is applied. The line, as shown in FIG. 9, includes two lateral shades D which are the ink shades being applied to both drawing tips 1, and a middle shade E which is the mixed shade of the inks. Therefore, the drawing pen can draw a line having different shades.

Figure 4:
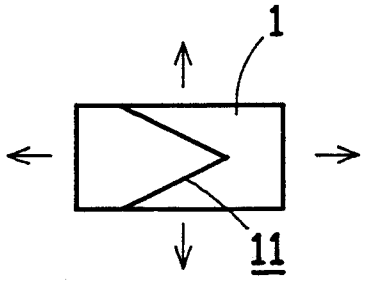
FIG. 4 shows two absorptive drawing tips side-matched through a V-shaped mortise and V-shaped tenon joint according to the present invention.

Referring to FIG. 4, therein illustrated is an alternate embodiment of the present invention in which the two drawing tips 1 are side-matched through a V-shaped mortise and V-shaped tenon joint 11 and adhered together by a watertight bonding agent.

Figure 5:
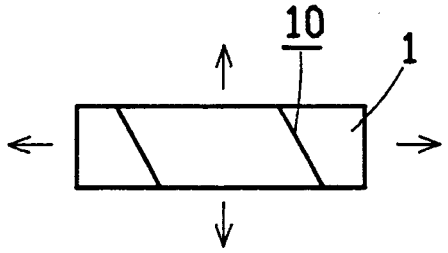
FIG. 5 shows three absorptive drawing tips side-matched with one another through a respective plain miter joint according to the present invention.

Referring to FIG. 5, therein illustrated is another alternate embodiment of the present invention, in which three drawing tips 1 are side-matched with one another through a respective plane miter joint 10 and adhered together by a watertight bonding agent. When the drawing pen is moved on a paper in one direction, a line having different shades will be applied; when the drawing pen is moved on the paper in another direction, a line having different shades in a different form will be applied.

Figure 6:
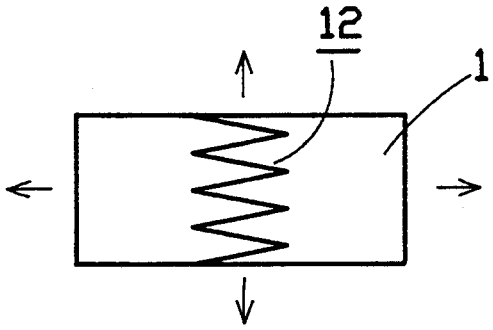
FIG. 6 shows two absorptive drawing tips side-matched through a finger joint according to the present invention.

Referring to FIG. 6, therein illustrated is still another alternate embodiment of the present invention, in which two drawing tips 1 are side-matched through a finger joint 12 and adhered together by a watertight bonding agent. When the drawing pen is moved on a paper in either direction, a line of different shades will be applied.

Figure 7:
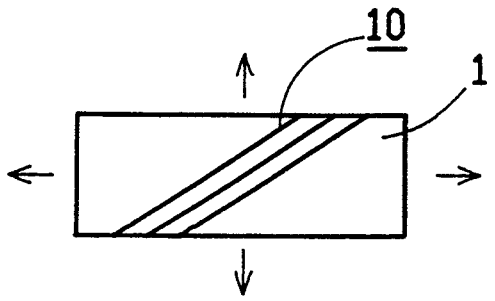
FIG. 7 shows four absorptive drawing tips side-matched with one another through a respective plane miter joint according to the present invention.

Referring to FIG. 7, therein illustrated is still another alternate embodiment of the present invention, in which four drawing tips 1 of different thickness are side-matched with one another through plane miter joints 10 and adhered together by a watertight bonding agent.

Figure 8:
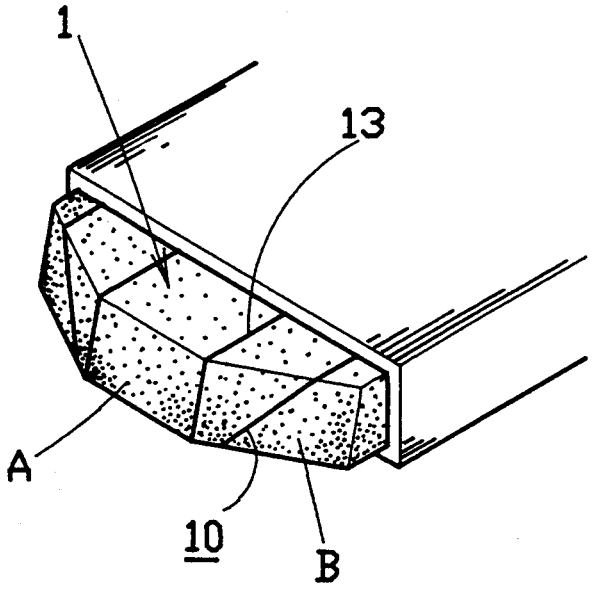
FIG. 8 shows two lateral pair of side-matched supplementary drawing tips and an intermediate master drawing tip side-matched according to the present invention.

Referring to FIG. 8, therein illustrated is still another alternate embodiment of the present invention, in which two lateral pairs of side-matched supplementary absorptive drawing tips B, which are respectively side-matched through a respective plane miter joint 10, and an intermediate master absorptive drawing tip A are side-matched through a butt joint 13 and all adhered together by a watertight bonding agent. The drawing pen may be held in the hand at different angles to move either all or some of the drawing tips on the paper so as to draw lines having different shades.

Figure 10:
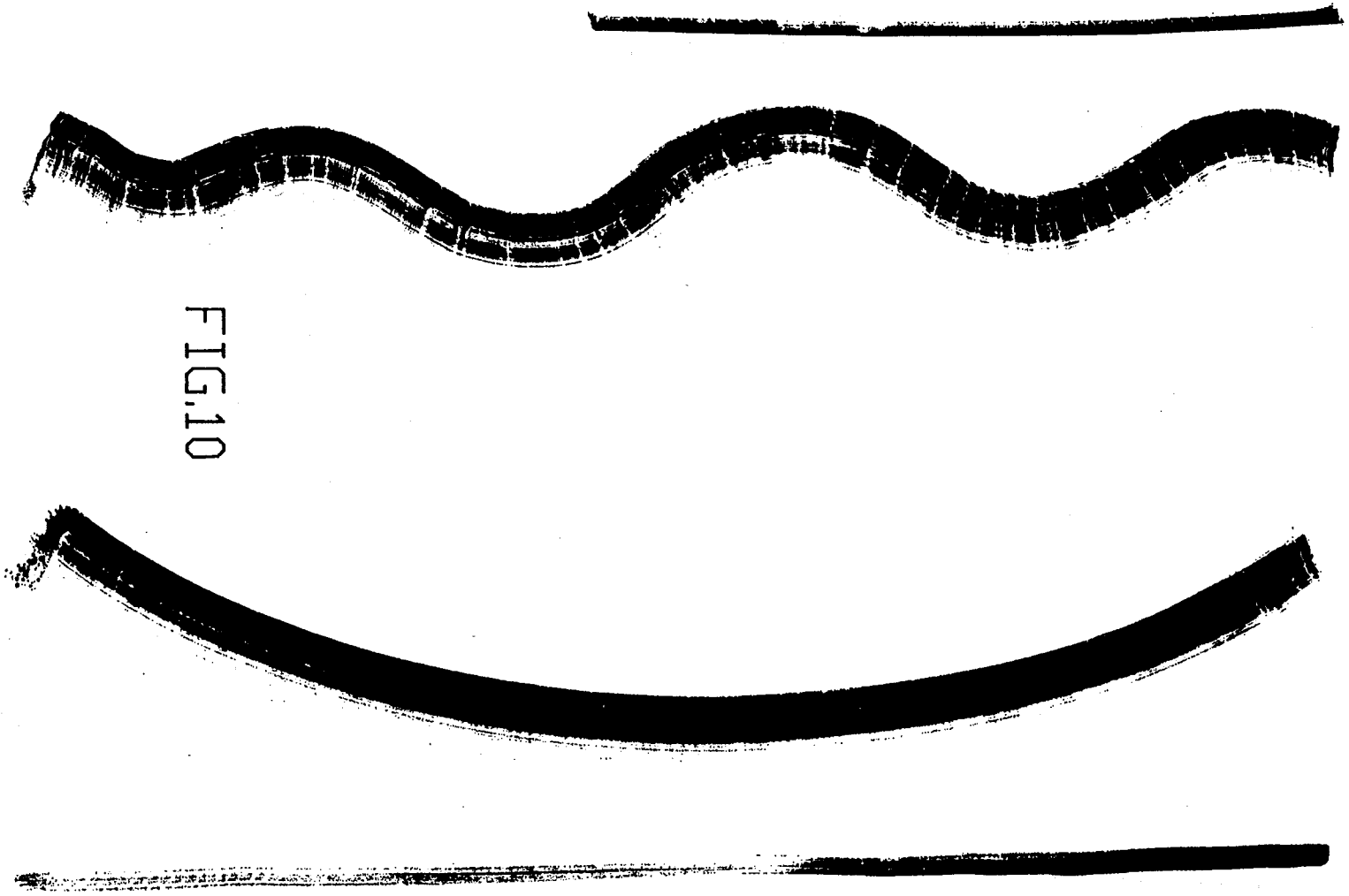
FIG. 10 shows different lines having different shades drawn by a drawing pen having side-matched absorptive drawing tips according to the present invention.
Figure 11:
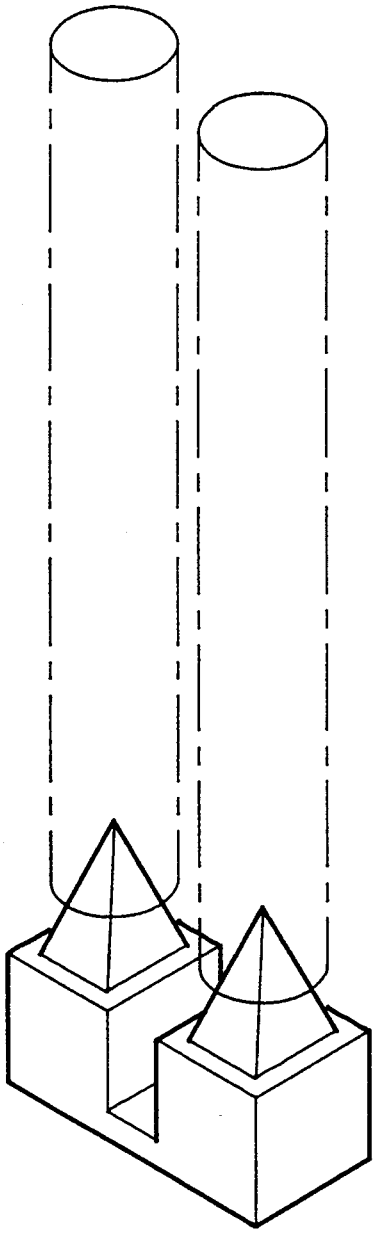
FIG.11 PRIOR ART
FIG. 11 shows an absorptive drawing tip connected to two ink reservoirs according to the prior art.

Referring to FIG. 10, the present invention can be used to draw curved lines, arched lines, and straight lines showing different shades.

While only few embodiments of the present invention have been shown and described, it will be understood that various modifications and changes could be made without departing from the spirit and scope of the invention.

I claim:

1. A drawing pen comprising a plurality of ink reservoirs received within a barrel thereof and a plurality of absorptive drawing tips each having a tip end and a top end, said plurality of absorptive drawing tips being connected at said top end to said plurality of ink reservoirs, each said tip end of said plurality of absorptive drawing tips being extended out of said barrel for drawing, said plurality of absorptive drawing tips being complimentarily engaged at said tip end and adhered together with a watertight bonding agent.

2. The drawing pen of claim 1 wherein said plurality of absorptive drawing tips are complimentarily engaged through a plane miter joint.

3. The drawing pen of claim 1 wherein said plurality of absorptive drawing tips are complimentarily engaged through a V-shaped mortise and V-shaped tenon joint.

4. The drawing pen of claim 1 wherein said plurality of absorptive drawing tips comprising at least three absorptive drawing tips complimentarily engaged through a plane miter joint.

5. The drawing pen of claim 1 wherein said plurality of absorptive drawing tips are complimentarily engaged through a finger joint.

6. The drawing pen of claim 1 wherein said plurality of absorptive drawing tips comprising a master absorptive drawing tip having two sides and two pairs of complimentarily engaged supplementary drawing tips disposed one on each of said two sides of said master absorptive drawing tip through a butt joint, each of said two pairs of supplementary drawing tips being complimentarily engaged through a plane miter joint.

* * * * *